US011440281B2

(12) United States Patent
Fridolfsson

(10) Patent No.: US 11,440,281 B2
(45) Date of Patent: Sep. 13, 2022

(54) DEVICE FOR ERECTING A FOLDED CARTON

(71) Applicant: Norden Machinery AB, Kalmar (SE)

(72) Inventor: Pär Fridolfsson, Kalmar (SE)

(73) Assignee: Norden Machinery AB, Kalmar (SE)

( * ) Notice: Subject to any disclaimer, the term of this patent is extended or adjusted under 35 U.S.C. 154(b) by 2 days.

(21) Appl. No.: 16/972,551

(22) PCT Filed: Jun. 5, 2019

(86) PCT No.: PCT/SE2019/050527

§ 371 (c)(1),
(2) Date: Dec. 4, 2020

(87) PCT Pub. No.: WO2019/236000

PCT Pub. Date: Dec. 12, 2019

(65) Prior Publication Data

US 2021/0237385 A1 Aug. 5, 2021

(30) Foreign Application Priority Data

Jun. 8, 2018 (SE) ..... 1850699-8

(51) Int. Cl.
*B31B 50/07* (2017.01)
*B31B 50/80* (2017.01)
(Continued)

(52) U.S. Cl.
CPC ..... *B31B 50/07* (2017.08); *B31B 50/042* (2017.08); *B31B 50/80* (2017.08); *B65B 41/06* (2013.01); *B65B 43/18* (2013.01); *B65B 43/28* (2013.01)

(58) Field of Classification Search
CPC ..... B65B 43/18; B65B 43/28; B65B 41/06; B31B 50/042; B31B 50/80; B31B 50/07; B31B 50/02
See application file for complete search history.

(56) References Cited

U.S. PATENT DOCUMENTS 5,215,515 A * 6/1993 Bershadsky ..... B31B 50/00 493/318
5,603,599 A * 2/1997 Wesslen ..... B65H 3/0883 493/317

(Continued)

FOREIGN PATENT DOCUMENTS

JP 2004001559 A 1/2004
WO 2011136725 A1 11/2011
WO 2011136726 A1 11/2011

OTHER PUBLICATIONS

International Search Report and Written Opinion for International Application No. PCT/SE2019/050527, dated Jul. 4, 2019 in 14 pages.

(Continued)

*Primary Examiner* — Thomas M Wittenschlaeger
(74) *Attorney, Agent, or Firm* — Knobbe, Martens, Olson & Bear, LLP

(57) ABSTRACT

In a carton feeding device for feeding cartons to a conveyor track, comprising a replaceable pick-up head attached to the carton feeding device at an attachment, where a pick-up head comprises a plurality of vacuum cups and an erecting means pivotally suspended at the pick-up head, where the attachment for the pick-up head is arranged on a rotor arm, where the attachment is adapted to receive different pick-up heads, and that the carton feeding device comprises an actuator means comprising a first interface adapted to actuate a leading edge erecting arm and a second interface adapted to actuate a trailing edge erecting arm. The advantage of the invention is that a carton feeding device that can easily be switched between leading edge erection or trailing edge erection of flat-folded cartons blanks is provided.

8 Claims, 5 Drawing Sheets

(51) Int. Cl.

| | |
|---|---|
| ***B65B 41/06*** | (2006.01) |
| ***B65B 43/18*** | (2006.01) |
| ***B65B 43/28*** | (2006.01) |
| ***B31B 50/04*** | (2017.01) |

(56) References Cited

U.S. PATENT DOCUMENTS 5,613,828 A * 3/1997 Haddow ..... B65B 43/305 493/315
6,168,149 B1 * 1/2001 Boldrini ..... B65H 3/44 271/99
7,585,265 B2 * 9/2009 Gebhardt ..... 493/70
7,788,881 B2 * 9/2010 Johnson ..... B65B 43/265 493/309
8,011,168 B2 * 9/2011 Devaux ..... B65B 21/18 53/247
9,126,380 B2 * 9/2015 Dittmer ..... B31B 50/00
9,284,076 B2 * 3/2016 Monti ..... B65B 43/285
10,137,656 B2 * 11/2018 Lundgren ..... B31B 50/786
10,183,813 B2 * 1/2019 Lundgren ..... B65G 47/04
11,072,141 B1 * 7/2021 Frederick ..... B31B 50/58
2007/0022714 A1 * 2/2007 Flagg ..... B65B 43/185 53/389.1
2007/0072756 A1 * 3/2007 Monti ..... B65B 59/003 493/309
2013/0039731 A1 * 2/2013 Lundgren ..... B31B 50/786 414/815
2015/0139772 A1 * 5/2015 Rapp ..... B65B 59/003 53/381.1
2016/0185066 A1 * 6/2016 Klein ..... B31B 50/00 493/162

OTHER PUBLICATIONS

International Preliminary Report on Patentability for International Application No. PCT/SE2019/050527, dated May 6, 2020 in 11 pages.

* cited by examiner

DEVICE FOR ERECTING A FOLDED CARTON

CROSS-REFERENCE TO RELATED APPLICATIONS

This application is the U.S. National Phase under 35. U.S.C. § 371 of International Application PCT/SE2019/050527, filed Jun. 5, 2019, which claims priority to Swedish Patent Application No. 1850699-8, filed Jun. 8, 2018. The disclosures of the above-described applications are hereby incorporated by reference in their entirety.

TECHNICAL FIELD

The present invention relates to a device adapted for erecting folded cartons. The device can be configured for erecting a carton either at the rear panel or at the front panel of the folded carton.

BACKGROUND ART

In the industry concerned with packing smaller objects such as tubes, bottles and the like in carton boxes, there is a constant need to increase the productivity of the packing machines. One aspect of a packing machine is the number of units that the machine can handle during a specific time interval. There are different ways of achieving a higher throughput in such a machine. One way is to reduce the cycle time for each object, i.e. to allow more objects to pass the machine during the same time interval. Such a solution is often difficult to achieve since it may involve a redesign of the machine and at some point, it is not possible to reduce the cycle time for a specific operation. Another way to increase the throughput in a production line is to use several parallel machines, at least for some operations. Such a solution requires more space and is not as cost-effective, but may be a possibility when an older production line is to be upgraded. Another way to increase the efficiency of a product line is to minimize the still-stand of the production line, e.g. when the production line is changed from one type of product to another type of product.

One type of machine that there may be a need to improve is the machine that pick up pre-glued folded paper cartons, erects them and feeds them to a conveyor track. On the conveyor track, the cartons continue to the next station, in which a tube or the like is inserted into the carton, with or without an instruction leaflet. The side flaps of the carton are then folded and the carton is closed, sealed if required, and packed in larger shipping units.

Depending on how the carton is designed, how it is to be placed in the conveyor track, and on how the folded carton is stored in the infeed magazine, there is a need to erect the folded carton from the proper side. In some systems, the folded carton is erected at the front panel of the folded carton, i.e. the side pointing in the moving direction of the conveyor track holding the erected cartons. In other systems, the folded carton is erected at the rear panel of the folded carton, i.e. the side pointing backwards to the moving direction of the conveyor track. The erected carton is then inserted in the conveyor track such that either the front panel or the rear panel of the erected carton will first bear on a holding teeth of the conveyor track.

EP 0800450 B1 describes a carton transfer assembly adapted to transfer folded cartons from a hopper, open them and transfer them to a conveyor. The cartons are opened by an extensible rod. The opened cartons are inserted in carton pockets provided between chain lugs. The length of the carton pocket is longer than the carton itself, thereby allowing the opened carton to be inserted into the carton pocket during the rotation of the rotary feeder.

U.S. Pat. No. 7,328,561 B2 and EP 1594745 B1 describe an apparatus for erecting boxes and setting them on a conveyor. The apparatus pick up folded boxes from a magazine, erects them and inserts them into conveyor cells on a conveyor track. The cartons are erected to a square shape by an erecting element and are inserted at the infeed end of the conveyor track. The cartons are inserted between lugs attached to the conveyor track and having a distance between them that corresponds to the width of the carton to be inserted. In order to be able to feed the carton to the conveyor track, the carton is inserted at the infeed end of the conveyor track, where the conveyor chain changes direction and is conveyed on a wheel. In this end region of the conveyor track, the lugs are angled apart due to the conveyor wheel, which allows the erected cartons to be inserted between the lugs. When the carton is inserted and the chain has moved somewhat, the lugs will be perpendicular to the conveyor chain again and will hold the carton in position. The height of the rear lug is substantially lower than the front lug in order to facilitate the insertion of the box. This requires two lugs for each box.

U.S. Pat. No. 5,573,490 describes an apparatus for erecting a folding box and folding its closure tabs before it is transferred into a conveyor device.

U.S. Pat. No. 4,331,436 describes a device for erecting and counter collapsing boxes from preformed blanks. The erected box may then be fed to a conveyor belt having compartment dividers adapted to hold the boxes. The boxes enter at the infeed end of the conveyor belt, where the conveyor belt changes direction and is conveyed on a wheel. In this end region of the conveyor belt, the compartment dividers are angled apart due to the conveyor wheel, which allows the erected boxes to enter between the compartment dividers.

EP 0331325 B1 describes a rotary transfer mechanism which is adapted to pick flat, collapsed cartons from a magazine. The cartons are picked from the magazine by a pick head having suctions cups. The cartons may open slightly during the removal from the magazine, but the cartons are substantially in their collapsed condition when the insertion of the carton into the conveyor begins. During the insertion, the leading corner hits a leading flight of the conveyor and since the pick head moves faster than the conveyor, the carton is pulled against the leading flight of the conveyor and is thus pulled open. In this way, a folded carton can be inserted between two parallel flights of the conveyor. One problem may be to handle cartons in which residual glue inside the carton causes the sides of the carton to stick to each other.

These devices for erecting flat-folded cartons may work well for some applications, but may be inflexible for different types of flat-folded cartons. There is thus room for improvements.

DISCLOSURE OF INVENTION

An object of the invention is therefore to provide a carton feeding device which is adapted for both leading edge and trailing edge carton erection.

The solution to the problem according to the invention is described in the characterizing part of claim 1. The other claims contain advantageous embodiments and further developments of the carton feeding device.

In a carton feeding device for feeding cartons to a conveyor track, comprising a replaceable pick-up head attached to the carton feeding device at an attachment, where the pick-up head comprises a plurality of vacuum cups and an erecting means pivotally suspended at the pick-up head, where the attachment for the pick-up head is arranged on a rotor arm, the object of the invention is achieved in that the attachment is adapted to receive different pick-up heads, and that the carton feeding device comprises an actuator means comprising a first interface adapted to actuate a leading edge erecting arm and a second interface adapted to actuate a trailing edge erecting arm.

By this first embodiment of the carton feeding device according to the invention, a carton feeding device is obtained that can be used for both leading edge carton erection and trailing edge carton erection. This is achieved in that the carton feeding device is provided with an actuator bar having an interface for both a leading edge carton erecting arm and a trailing edge carton erecting arm. A carton feeding device can thus be altered from erecting folded cartons at a leading edge to a carton feeding device erecting folded cartons at a trailing edge by replacing the pick-up head. Since the actuating means for the erecting device is adapted to be used for both leading edge carton erection and trailing edge carton erection, the switch between leading edge carton erection and trailing edge carton erection is simple.

In one example of the carton feeding device, the pick-up head comprises an erecting means adapted for leading edge erection of folded cartons. The erecting means is in the example mounted on the rear side of the pick-up head when seen in the direction of movement of the conveyor track. The erecting means will in this example bear on the rear panel of the folded carton. The erecting means is actuated by an actuator means arranged on the carton feeding device. The erecting means may be symmetrical and it may be possible to remove the erecting means from the pick-up head and to mount it on the front side of the pick-up head. In this way, the erecting means will now be adapted for trailing edge erection of folded cartons, and will bear on the front panel of a folded carton. This transformation can be done since the actuating means is adapted for actuating both a leading edge erection arm and a trailing edge erection arm.

In one example the pick-up head with the erecting means can be replaced with a pick-up head having another size or type of erecting means. The pick-up head is attached to the carton feeding device with a releasable attachment means having a specific mechanical interface, such that the pick-up head can be released and attached in a quick manner. The pick-up head is released by using a quick release means, e.g. a lever or the like, and can then be pulled away from the carton feeding device, and another pick-up head can be pushed on the attachment and fastened by the lever.

The pick-up heads may have different sizes. The length of a pick-up head may vary depending on the length of a folded carton and the pick-up head may be provided with different numbers of vacuum cups, e.g. two, three or four, depending on the length of the folded carton. The width of the pick-up head may also vary, depending on the width of a folded carton and on the type of erection of the folded carton.

For a leading edge erection of folded cartons, the folded carton is in the shown example always held close to the bend line between the upper panel and the rear panel, and the folded carton is always erected in the same way. This means that for a leading edge erection of folded cartons, the erecting means will be arranged at the same position regardless of the width of the carton, i.e. the width of the upper panel of the folded carton.

For a trailing edge erection of folded cartons, the folded carton will also be held close to the bend line between the upper panel and the front panel, and since the carton feeding device will insert the cartons in the same conveyor in the same way, the width of the pick-up head must be adapted to the width of the carton, i.e. the width of the upper panel of the folded carton. This means that for a trailing edge erection of folded cartons, the erecting means will be arranged at a different position of the carton feeding device depending on the width of the carton, i.e. the width of the upper panel of the folded carton. The actuating means is adapted for the different widths of cartons.

It is also possible to design the conveyor track such that cartons erected with a trailing edge erection will always be held at the same position, and that the width of the pick-up head varies with the width of the cartons for leading edge erection. In this way, the pick-up head will have the same positions for differently sized cartons for trailing edge erection, and will change position when leading edge erection is used.

The actuating means is provided with a first interface adapted to actuate a leading edge erecting arm and a second interface adapted to actuate a trailing edge erecting arm. In one example, the first interface and the second interface are grooves arranged in an actuating bar. The first interface must only be able to handle the fixed position of the leading edge erecting arm. The groove may thus be relatively short. The second interface must be able to handle all widths of cartons and thus the different positions of the trailing edge erecting arm, which means that the second groove may be relatively long, and longer than the groove of the first interface.

The cartons are inserted in a conveyor at an end region of the conveyor, where the teeth are angled apart during the insertion of the erected carton. This type of inserting cartons in a conveyor is well-known to the skilled person and is not described closer.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims.

Figure 1:
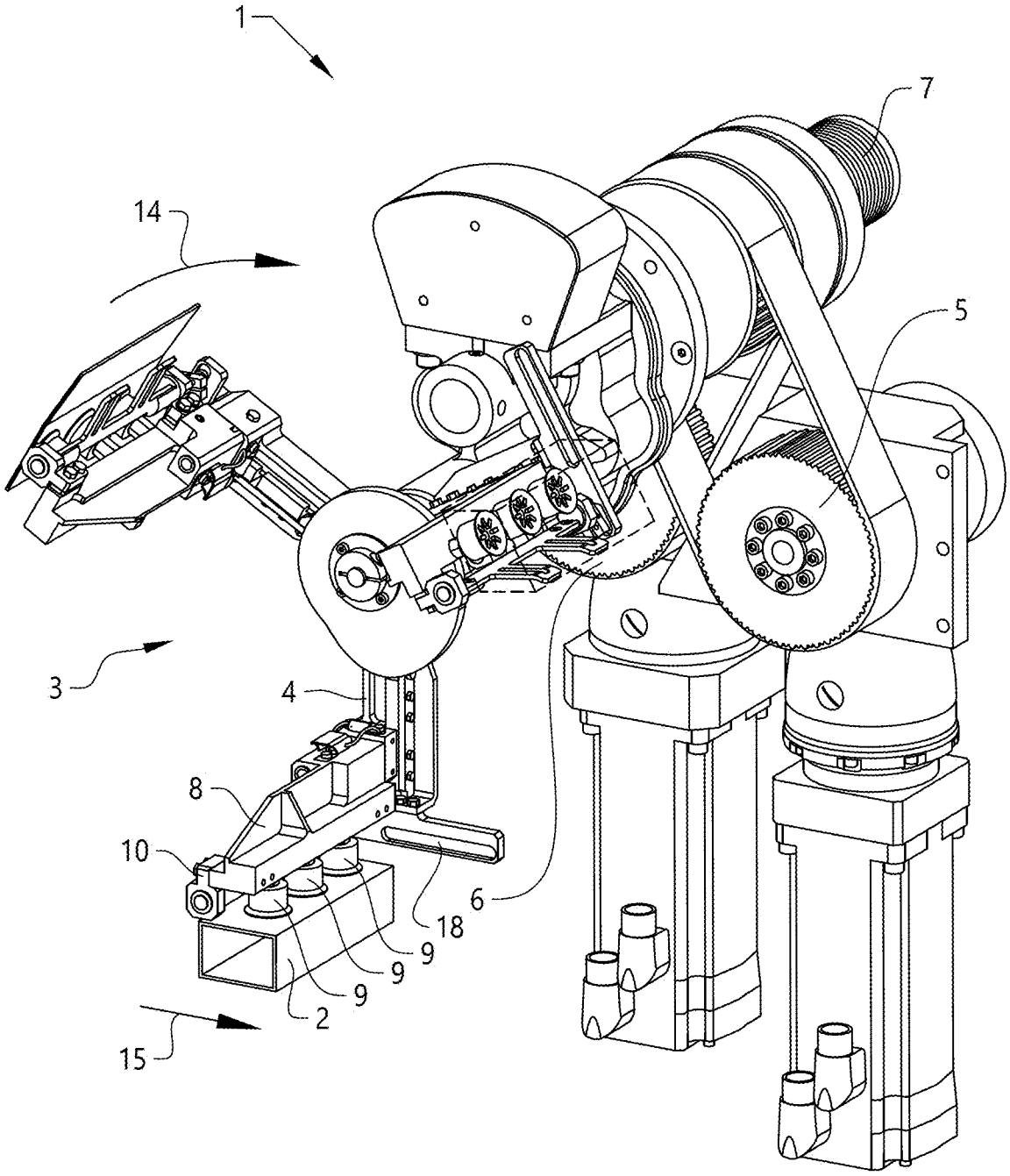
FIG. 1 shows a carton feeding device according to the invention.
Figure 2:
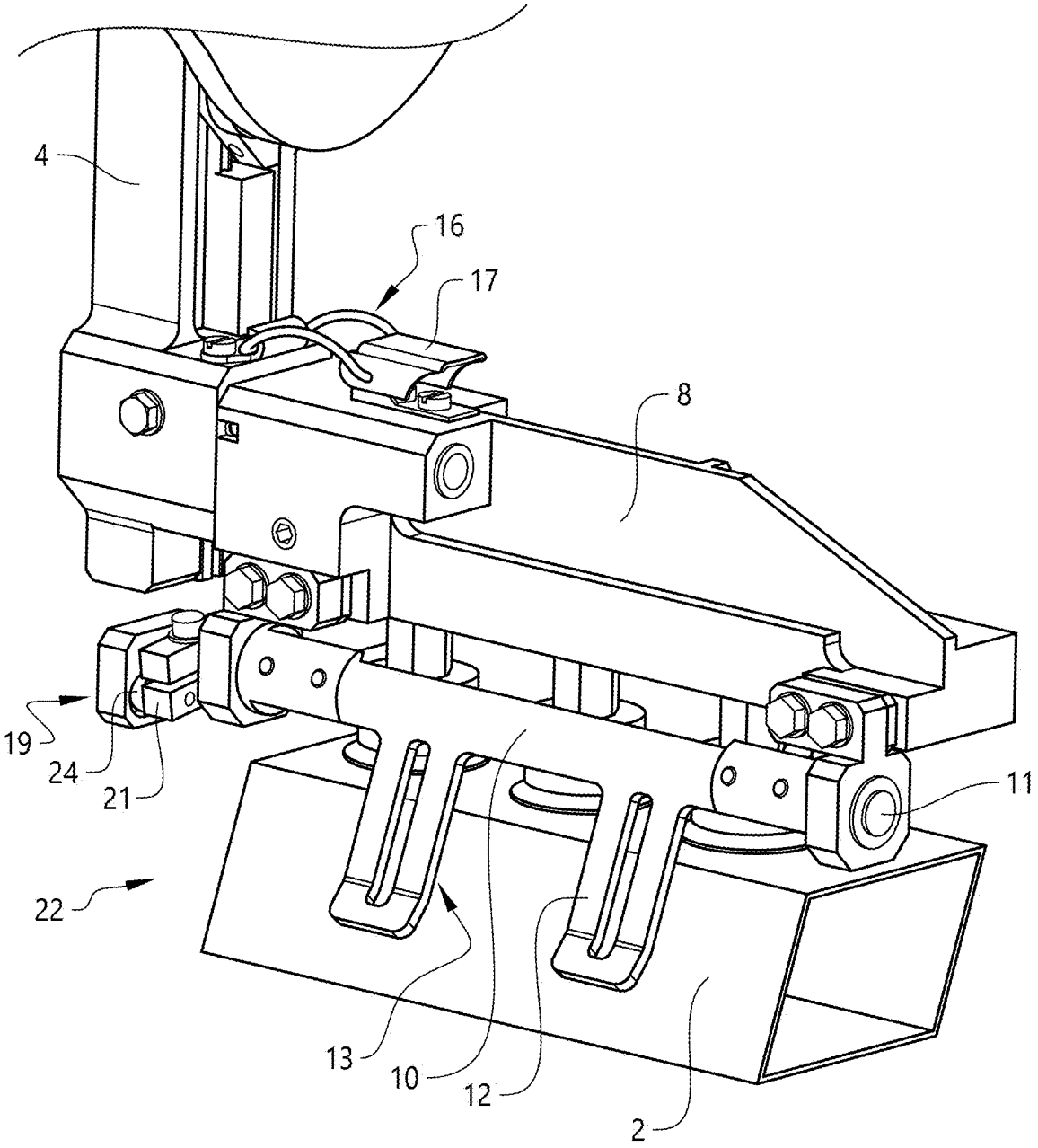
FIG. 2 shows a view of a pick-up head adapted for leading edge carton erection according to the invention.
Figure 3:
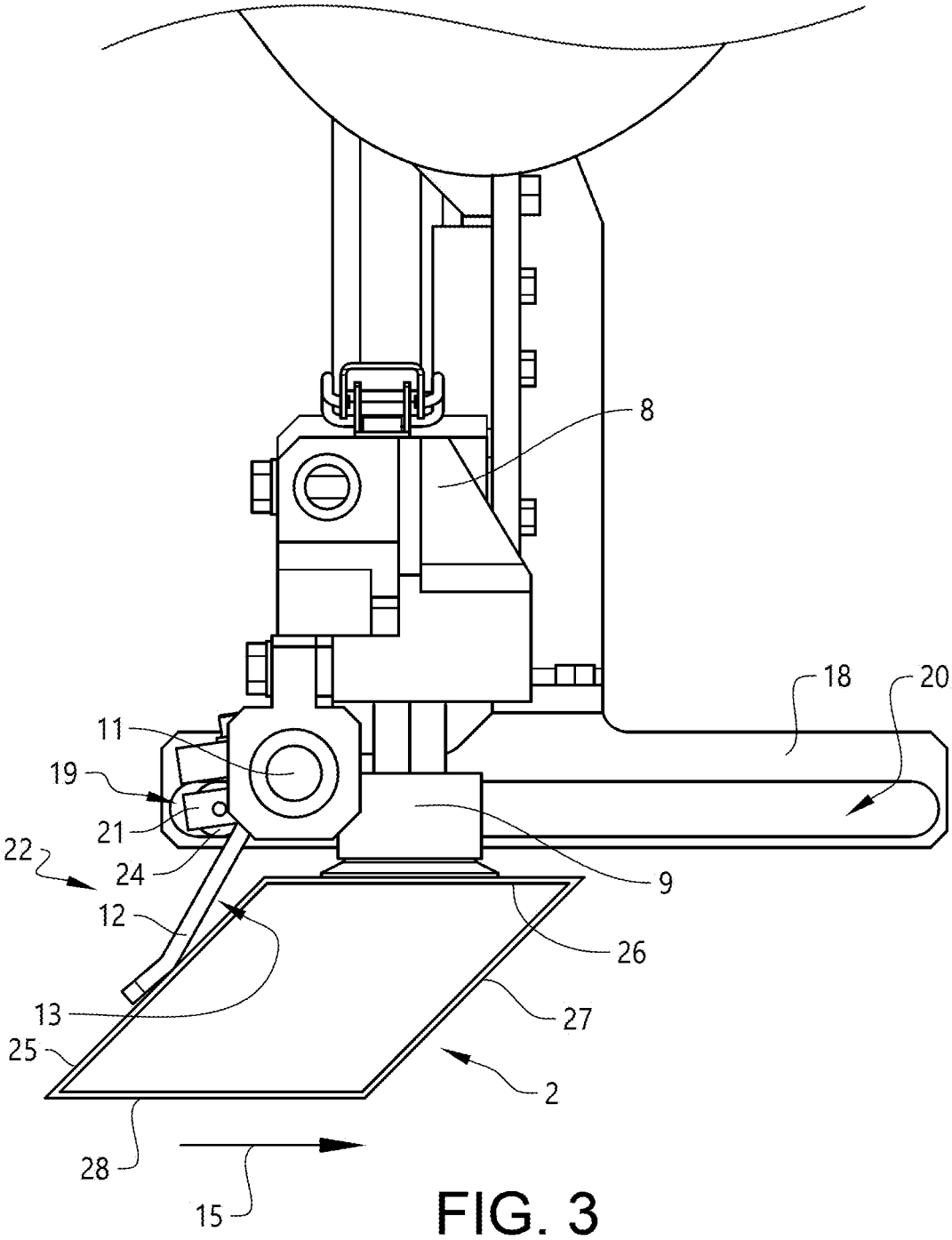
FIG. 3 shows a side view of the pick-up head of FIG. 2.

FIGS. 1 to 3 show a first embodiment of a carton feeding device 1 adapted for leading edge erection of folded cartons 2. The carton feeding device 1 comprises a rotor 3 provided with a plurality of rotor arms 4. In the shown example, the rotor 3 comprises three rotor arms 4, each provided with a pick-up head 8. The movement and rotation of the rotor 3 is controlled by a first servo motor 5 and a second servo motor 6 which are controlled individually by a control system of the carton feeding device. The rotor is arranged asymmetrical on the main shaft 7 of the carton feeding device 1, such that the rotor allows a folded carton to be picked up from a magazine, to be erected and subsequently to be inserted in a conveyor track having holding teeth to hold the erected cartons.

In the shown example, the rotor rotates in a clockwise direction indicated by arrow 14. At the insertion point, shown at the lowermost pick-up head in FIG. 1, the pick-up head will change direction for a short while and will move along the conveyor track for a short distance, i.e. will perform a movement to the right in the figure, along arrow 15. This movement is enabled by the two servo motors and the design of the rotary system of the carton feeding device.

The sides of the carton 2 will in this description be referred to as the rear panel 25, the upper panel 26, the lower panel 27 and the rear panel 28.

These references indicate the directions of the sides of a carton being conveyed in the conveyor track, with reference to the moving direction of the conveyor track. When a carton blank is erected or opened, a rectangular or square box body is obtained, into which an object such as a tube or bottle is to be inserted, before the box is closed and/or sealed. The degree of erection that a folded carton is erected when inserted into the conveyor track is selectable, and depends e.g. on the conveyor track and the way the carton is inserted into the conveyor track. In FIG. 1, the shown carton is fully erected at the insertion point.

The shown carton feeding device is adapted to insert erected cartons at the infeed region of a conveyor track, where the teeth are angled away from each other, creating a larger opening into which the carton is inserted. When the teeth are parallel again, the carton will be held securely in position. The shown carton feeding device is capable of reaching an insertion rate of up to 300 insertions per minute.

FIGS. 2 and 3 show a pick-up head 8 provided with a leading edge erecting arm 22. The pick-up head 8 is exchangeable and is attached to the rotor arm 4 at an attachment means 16 that comprises suitable steering means for the correct positioning of the pick-up head to the attachment means. The pick-up head 8 is fastened to the rotor arm by a quick release means, e.g. a lever or the like. In the shown example, the pick-up head is fastened to the rotor arm with a buckle 17. The pick-up head 8 is provided with a plurality of vacuum cups 9 adapted to pick up and hold a flat-folded carton blank 2 during the insertion of an erected carton in a conveyor track. The vacuum cups are provided with vacuum through a vacuum conduit running through the attachment means and through the pick-up head. The number of vacuum cups are chosen with respect to the size and weight of the folded carton. A suitable number of vacuum cups is two, three or four. In the shown example, three vacuum cups are used. The length of the pick-up head is preferably adapted to the length of a carton.

In this example, the erecting means 10 of the pick-up head 8 comprises a leading edge erecting arm 22. The leading edge erecting arm 22 is arranged to pivot around an erecting axle 11 and is provided with one or more erecting fingers 12. The erecting fingers 12 comprises a bearing surface 13 that will bear on the flat-folded carton blank and that will erect the carton blank before insertion of the carton in the conveyor track.

The carton feeding device 1 comprises an actuator means 18 adapted to control the erecting means 10 to erect a flat-folded carton. The actuator means 18 is controlled by a rotor disc arranged at the centre of the rotor 3 and is in one example arranged on an arm having a roller running in a steering groove of the rotor disc. The actuator means is provided with a first interface 19 adapted to actuate a leading edge erecting arm 22 and a second interface 20 adapted to actuate a trailing edge erecting arm 23. In the shown example, the first interface 19 and the second interface 20 are longitudinal grooves arranged in the actuator means 18. The first groove is relatively short since the leading edge erecting arm 22 in the shown example will always have the same position on the carton feeding device. The second groove may be longer in order to be able to allow for different positions of the trailing edge erecting arm on the carton feeding device.

The first interface and the second interface may also comprise a ridge on which two rollers of an actuator arm runs. Since the actuator means moves in a straight vertical direction and the erecting means performs a rotational movement, the actuator arm of the actuator means and the erecting means will displace relative each other during an erection of a carton. For this reason, a roller running in a groove is a simple and reliable solution. Further, a roller and a groove simplifies the exchange of different pick-up heads, since the roller will be positioned in the groove without any further attachment needs.

For a leading edge erection of folded cartons, the folded carton is in the shown example always held close to the bend line between the upper panel 26 and the rear panel 25, and the folded carton is always erected in the same way. This means that for a leading edge erection of folded cartons, the erecting means will be arranged at the same position regardless of the width of the carton, i.e. the width of the upper panel of the folded carton. For this reason, the first interface 19 will always cooperate with a leading edge erecting arm arranged in the same position on the carton feeding device. The groove of the first interface may thus be relatively short.

The actuator means 18 will displace somewhat in a vertical direction when a carton blank is to be erected. This displacement is transferred to the erecting means by an actuator arm 21 that is attached to the erecting means in an adjustable manner. The actuator arm can be adjusted in order to control the degree of erection of a carton. The actuator arm 21 is provided with a roller 24 arranged to roll in the first groove. When the actuator means is displaced, the roller will pivot the actuator arm which in turn pivots the erecting means. The actuator means will retract when the erected carton has been inserted into the conveyor track. In the shown example, the first interface 19 will cooperate with the roller 24 of the leading edge erecting arm 22.

Figure 4:
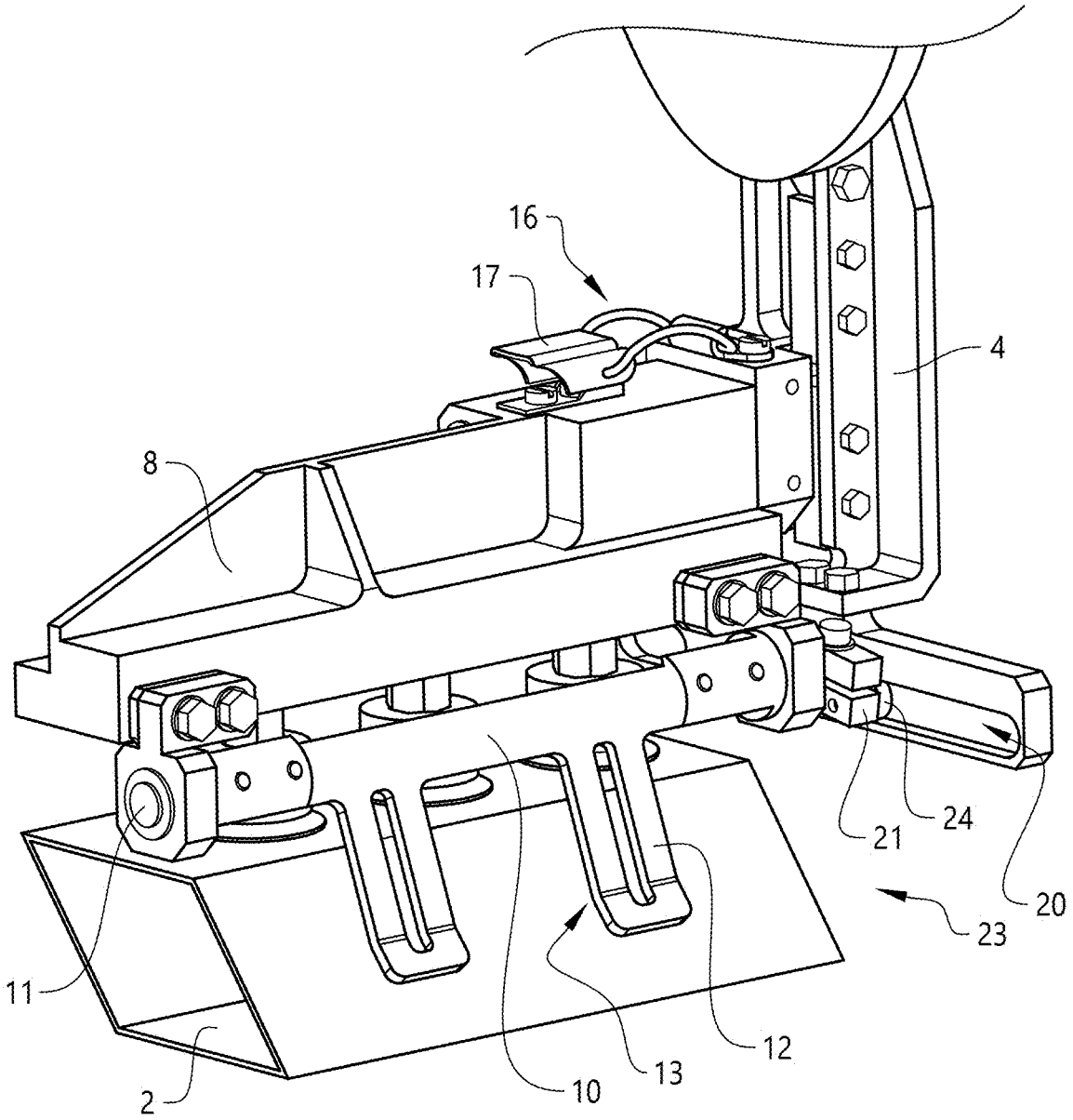
FIG. 4 shows a view of a pick-up head adapted for trailing edge carton erection according to the invention.
Figure 5:
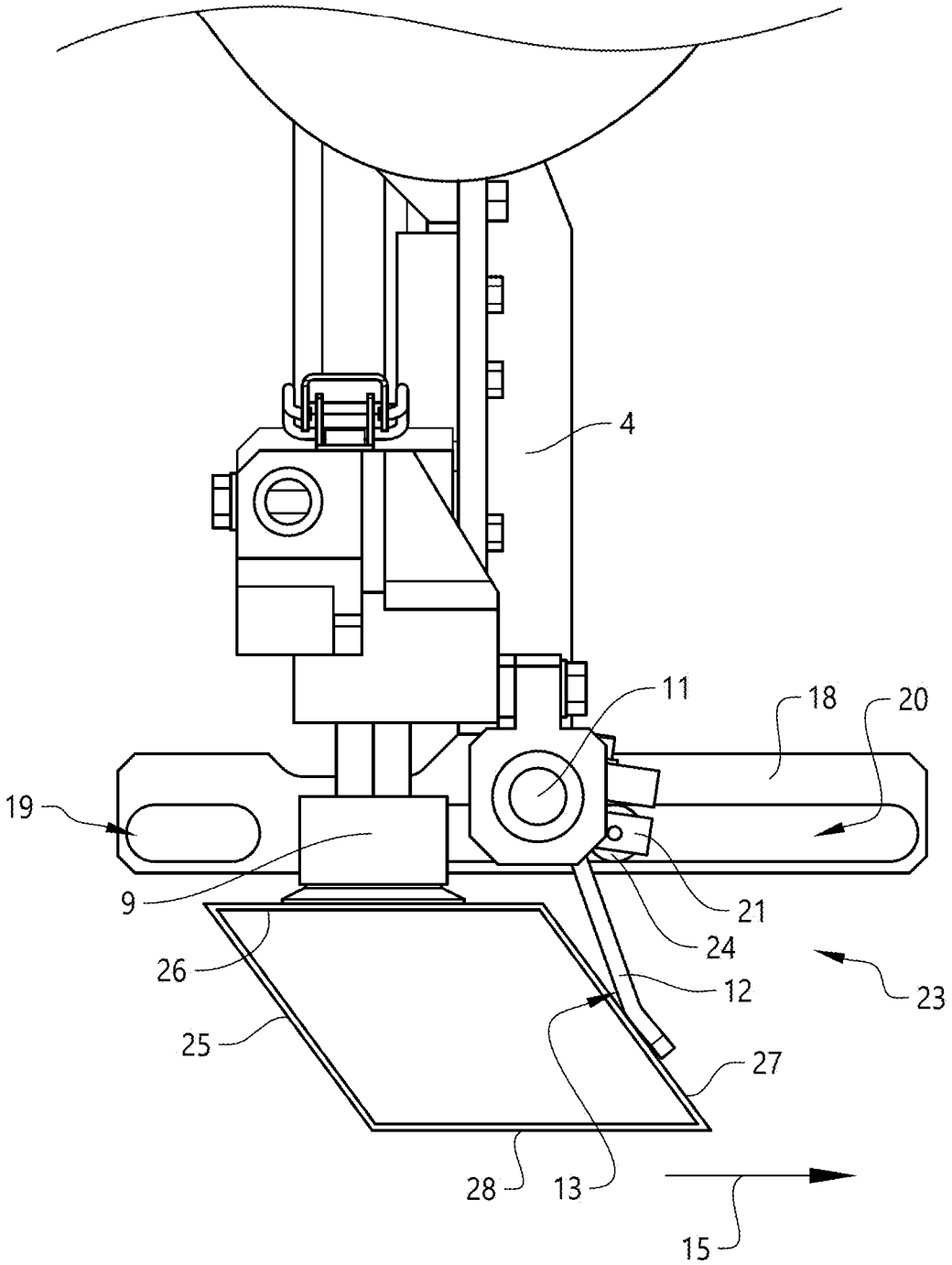
FIG. 5 shows a side view of the pick-up head of FIG. 4.

FIGS. 4 and 5 show a pick-up head 8 provided with a trailing edge erecting arm 23. The pick-up head 8 is exchangeable and is attached to the rotor arm 4 at an attachment 16 that comprises suitable steering means for the correct positioning of the pick-up head at the attachment. The pick-up head 8 is fastened to the rotor arm by a quick release means 17, e.g. a lever or the like. In the shown example, the pick-up head is fastened to the rotor arm with a buckle. The pick-up head 8 is provided with a plurality of vacuum cups 9 adapted to pick up and hold a flat-folded carton blank 2 during the erection and insertion of an erected carton in a conveyor track. The vacuum cups are provided with vacuum through a vacuum conduit running through the attachment means and through the pick-up head. The number of vacuum cups are chosen with respect to the size and weight of the carton. A suitable number of vacuum cups is two, three or four. In the shown example, three vacuum cups are used. The length of the pick-up head is preferably adapted to the length of a carton.

In this example, the erecting means 10 of the pick-up head 8 comprises a trailing edge erecting arm 23. The erecting means 10 is arranged to pivot around an erecting axle 11 and is provided with one or more erecting fingers 12. The erecting fingers 12 comprises a bearing surface 13 that will bear on the flat-folded carton blank and that will erect the carton blank before insertion of the carton in the conveyor track. The difference between a leading edge erecting arm 22 and a trailing edge erecting arm 23 is the side on which the actuator arm 21 is arranged on the erecting axle 11.

In this example, the second interface 20 of the actuator means 18 will actuate the trailing edge erecting arm 23 to erect a flat-folded carton. The groove of the second interface will cooperate with the roller 24 of the trailing edge erecting arm 23.

For a trailing edge erection of folded cartons, the folded carton should preferably be held close to the bend line between the upper panel 26 and the front panel 27, and since the carton feeding device will insert the cartons in the same manner in the conveyor, the width of the pick-up head must be adapted to the width of the carton, i.e. the width of the upper panel of the folded carton. In order for the pick-up head to be able to hold the folded carton close to the bend line between the upper panel 26 and the front panel 27, the width of the pick-up head must be adapted to the width of the upper panel of the carton. This means that for trailing edge erection of folded cartons, the erecting means 10 will be arranged at different position of the carton feeding device depending on the width of the carton, i.e. the width of the upper panel of the folded carton. For this reason, the second interface is adapted for the different widths of cartons. The length of the second interface is selected in dependency of the width of the folded cartons that are to be used, and may e.g. be at least twice as long as the first interface. In this way, it is easy to change the size of cartons that a carton feeding device are to handle, by only replacing the pick-up head and without having to rebuild the actuating means. In the shown example, the carton is not fully erected to a quadratic shape. The degree of erection of a carton depends on the used conveyor track and the used type of insertion of the carton. It is e.g. possible to counterfold the carton to a shape similar to the shape shown in FIG. 3.

The invention is not to be regarded as being limited to the embodiments described above, a number of additional variants and modifications being possible within the scope of the subsequent patent claims. The pick-up head can be adapted to various sizes of cartons.

REFERENCE SIGNS

1: Carton feeding device
2: Carton
3: Rotor
4: Rotor arm
5: First servo motor
6: Second servo motor
7: Main axle
8: Pick-up head
9: Vacuum cup
10: Erecting means
11: Erecting shaft
12: Erecting finger
13: Bearing surface
14: Rotation direction
15: Moving direction
16: Attachment
17: Quick release means
18: Actuator means
19: First interface
20: Second interface
21: Actuator arm
22: Leading edge erecting arm
23: Trailing edge erecting arm
24: Roller
25: Rear panel
26: Upper panel
27: Front panel
28: Lower panel

What is claimed is:

1. A carton feeding device for feeding cartons to a conveyor track from a magazine, comprising:

a pick-up head releasably attached to the carton feeding device at an attachment, where the pick-up head comprises a plurality of vacuum cups and an erecting arm pivotally suspended at the pick-up head, where the attachment for the pick-up head is arranged on a rotor arm, wherein the attachment is adapted to receive the pick-up head provided with the erecting arm where the erecting arm is adapted for leading edge erection of a carton or to receive the pick-up head provided with the erecting arm where the erecting arm is adapted for trailing edge erection of a carton, where the carton feeding device comprises an actuator, where the actuator comprises a first interface adapted to interact with the erecting arm adapted for leading edge erection of a carton and a second interface adapted to interact with the erecting arm adapted for trailing edge erection of a carton.

2. The device according to claim 1, wherein the second interface is longer than the first interface.

3. The device according to claim 1, wherein the first interface and the second interface is a groove arranged in the actuator.

4. The device according to claim 1, wherein the second interface is at least twice as long as the first interface.

5. The device according to claim 1, wherein the pick-up head is attached to the attachment with a quick release.

6. The device according to claim 1, wherein the erecting arm comprises an actuator arm adapted to transfer a movement of the actuator to the erecting arm.

7. The device according to claim 6, wherein the actuator arm comprises a roller adapted to interact with the first interface or the second interface.

8. The device according to claim 6, wherein the actuator arm is adjustable such that the erection degree of the erecting arm can be set.

* * * * *